US010370149B2

(12) United States Patent
Peng

(10) Patent No.: US 10,370,149 B2
(45) Date of Patent: Aug. 6, 2019

(54) BOTTLE NECK STRUCTURE

(71) Applicant: Pandian Peng, Shenzhen (CN)

(72) Inventor: Pandian Peng, Shenzhen (CN)

( * ) Notice: Subject to any disclaimer, the term of this patent is extended or adjusted under 35 U.S.C. 154(b) by 0 days.

(21) Appl. No.: 15/040,708

(22) Filed: Feb. 10, 2016

(65) Prior Publication Data

US 2017/0225834 A1 Aug. 10, 2017

(51) Int. Cl.

| | |
|---|---|
| ***A61J 7/04*** | (2006.01) |
| ***B65D 23/14*** | (2006.01) |
| ***B65D 1/02*** | (2006.01) |
| *B65D 51/24* | (2006.01) |
| *B65D 41/04* | (2006.01) |

(52) U.S. Cl.

CPC ..... *B65D 23/14* (2013.01); *B65D 1/0246* (2013.01); *A61J 7/04* (2013.01); *A61J 2200/70* (2013.01); *B65D 41/0435* (2013.01); *B65D 51/245* (2013.01)

(58) Field of Classification Search

CPC ..... B65D 41/0435; B65D 51/245; B65D 1/0246; B65D 23/14; A47J 7/04; A47J 2200/70

USPC ..... 220/259.3, 676; 206/459.1, 534; 116/308, 309; 215/220, 230

See application file for complete search history.

(56) References Cited

U.S. PATENT DOCUMENTS 2,450,949 A * 10/1948 Gattuccio ..... A61J 7/04 116/308
2,767,680 A * 10/1956 Lermer ..... A61J 7/04 116/308
3,446,179 A * 5/1969 Bender ..... A61J 7/04 116/308
3,960,713 A * 6/1976 Carey ..... A61J 7/04 116/308
4,220,247 A * 9/1980 Kramer ..... A61J 7/04 116/308
4,365,722 A * 12/1982 Kramer ..... A61J 7/04 116/308
4,440,306 A * 4/1984 Van Buskirk ..... B65D 55/02 215/230
4,511,050 A * 4/1985 Nicol ..... A61J 7/04 116/308
4,548,157 A * 10/1985 Hevoyan ..... A61J 7/04 116/308
4,705,182 A * 11/1987 Newel-Lewis ..... A61J 7/04 116/308
4,749,093 A * 6/1988 Trick ..... B65D 41/06 116/308
4,802,438 A * 2/1989 DeJonge ..... A61J 7/04 116/308

(Continued)

FOREIGN PATENT DOCUMENTS

WO WO2014183131 * 11/2014 ..... A61J 7/04

*Primary Examiner* — J. Gregory Pickett
*Assistant Examiner* — Elizabeth Volz

(57) ABSTRACT

The present invention relates to a bottle neck structure comprising an inner ring and an outer ring, a plurality of protrusions and a plurality of recesses; wherein the inner ring further comprising a plurality of display panels, an annular rim, a top facing surface; and wherein the outer ring further comprising a annular groove, a bottom facing surface and one through hole, and wherein each of the display panels can be viewed through the through hole when they are aligned.

18 Claims, 3 Drawing Sheets

(56) References Cited

U.S. PATENT DOCUMENTS 4,877,119 A * 10/1989 Hosking ..... A47G 23/16 116/227
5,082,129 A * 1/1992 Kramer ..... B65D 50/046 215/216
5,184,739 A * 2/1993 Kusz ..... A61J 7/04 116/308
5,269,085 A * 12/1993 Chiapetta ..... A45D 40/00 215/230
5,284,262 A * 2/1994 O'Nan ..... B65D 55/145 215/206
5,662,224 A * 9/1997 Nogues ..... A61J 7/04 206/534
5,732,836 A * 3/1998 Barker ..... A61J 7/02 215/203
5,967,350 A * 10/1999 Jones ..... B65D 41/06 116/309
6,059,133 A * 5/2000 Lai ..... B65D 51/245 116/309
6,068,149 A * 5/2000 Telega ..... A61J 7/04 116/308
6,089,180 A * 7/2000 Nichols, Jr. ..... G09F 11/23 116/308
6,324,123 B1 * 11/2001 Durso ..... A61J 7/0481 221/15
6,565,743 B1 * 5/2003 Poirier ..... B65D 51/00 116/284
6,805,072 B1 * 10/2004 DeSano ..... A61J 7/04 116/308
8,051,997 B2 * 11/2011 Buckley ..... A47G 23/16 215/230
8,136,687 B2 * 3/2012 Wu ..... A61J 1/03 215/206
8,534,220 B1 * 9/2013 Olson ..... G09F 11/23 116/308
8,579,116 B2 * 11/2013 Pether ..... B65D 50/068 116/201
8,689,988 B2 * 4/2014 Xu ..... A61J 7/04 116/308
8,709,518 B2 * 4/2014 Young Jones ..... A61J 11/002 116/308
8,887,656 B2 * 11/2014 Killinger ..... A61M 1/0001 116/306
9,622,939 B2 * 4/2017 Buxton-Dakides ..... A61J 1/03
9,775,779 B2 * 10/2017 Ali ..... A61J 7/04
D806,567 S * 1/2018 Ammar ..... D9/719
2003/0192468 A1 * 10/2003 Goertzen ..... G09F 11/23 116/309
2008/0099423 A1 * 5/2008 Koch ..... A61J 7/04 215/230
2009/0127157 A1 * 5/2009 Costa ..... B65D 51/04 206/534
2011/0284415 A1 * 11/2011 Balakier ..... A61J 7/04 206/459.1

* cited by examiner

BOTTLE NECK STRUCTURE

TECHNICAL FIELD

The present invention relates to a bottle structure, ire particular to a bottle neck structure.

BACKGROUND

In today's world, people bring with them, when they travel, products that they use daily such as cosmetics, shampoo, especially during long vacation or business trips. However, the conventional containers for storing such products are too large and inconveniently to travel with.

What is needed is a type of travel bottle that is easy to install and has display panels to conveniently display the contents in the bottle.

SUMMARY OF INVENTION

The present invention relates to a bottle neck structure comprising an inner ring and an outer ring, a plurality of protrusions and a plurality of recesses; wherein the inner ring further comprising a plurality of display panels, an annular rim, a top facing surface; and wherein the outer ring further comprising a annular groove, a bottom facing surface and one through hole, and wherein each of the display panels can be viewed through the through hole when they are aligned.

In one embodiment, the plurality of recesses are disposed in the bottom facing surface, and the plurality of protrusions are disposed on the top facing surface.

In another embodiment, the plurality of protrusions are disposed in the bottom facing surface, and the plurality of recesses are disposed on the top facing surface, In another embodiment, the annular rim is located at the top of the inner ring, the plurality of displace panels are disposed on the outer surface of the inner ring, the annular groove is disposed on the inner surface of the outer ring, the the bottom facing surface is formed in the inner surface of the outer ring, and the through holes is located on the outer ring.

In another embodiment, the plurality of recesses are symmetrically disposed on the top facing surface of the inner ring, and the plurality of protrusions are symmetrically disposed in the bottom facing surface of the outer ring.

In another embodiment, the plurality of protrusions are symmetrically disposed on the top facing surface of the inner ring, and the plurality of recesses are symmetrically disposed in the bottom facing surface of the outer ring.

In another embodiment, the plurality of protrusions are circular shape and wherein the plurality of recesses are circular shape.

In another embodiment, the inner ring further comprising a plurality of ribs.

In another embodiment, the outer ring further comprising a thread structure for coupling with a bottle cap.

DETAILED DESCRIPTION

Figure 1:
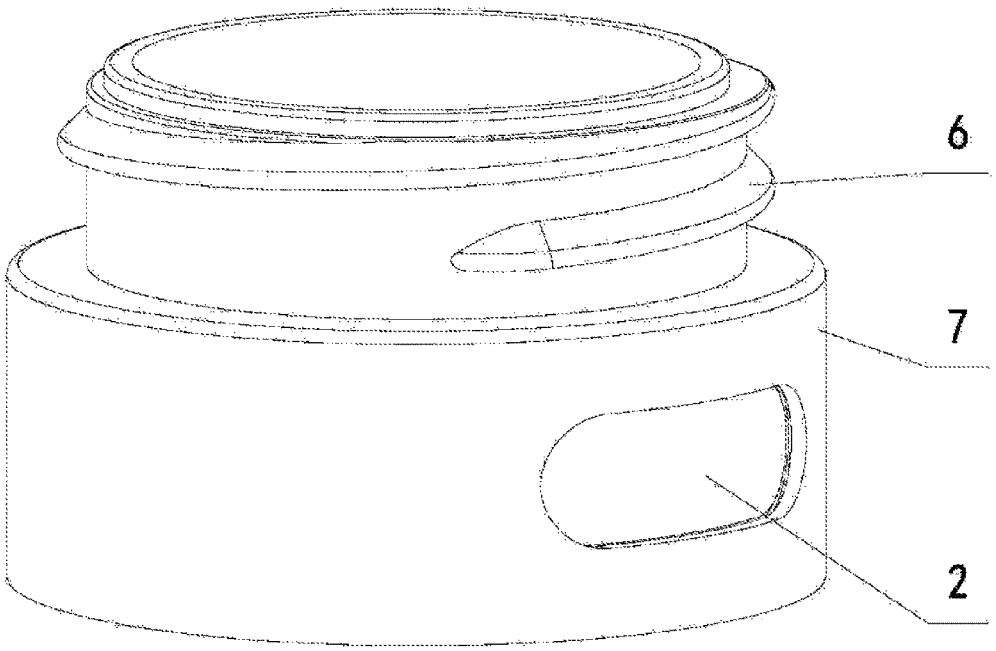
FIG. 1 is a schematic view of one embodiment of the bottle neck structure.
Figure 2:
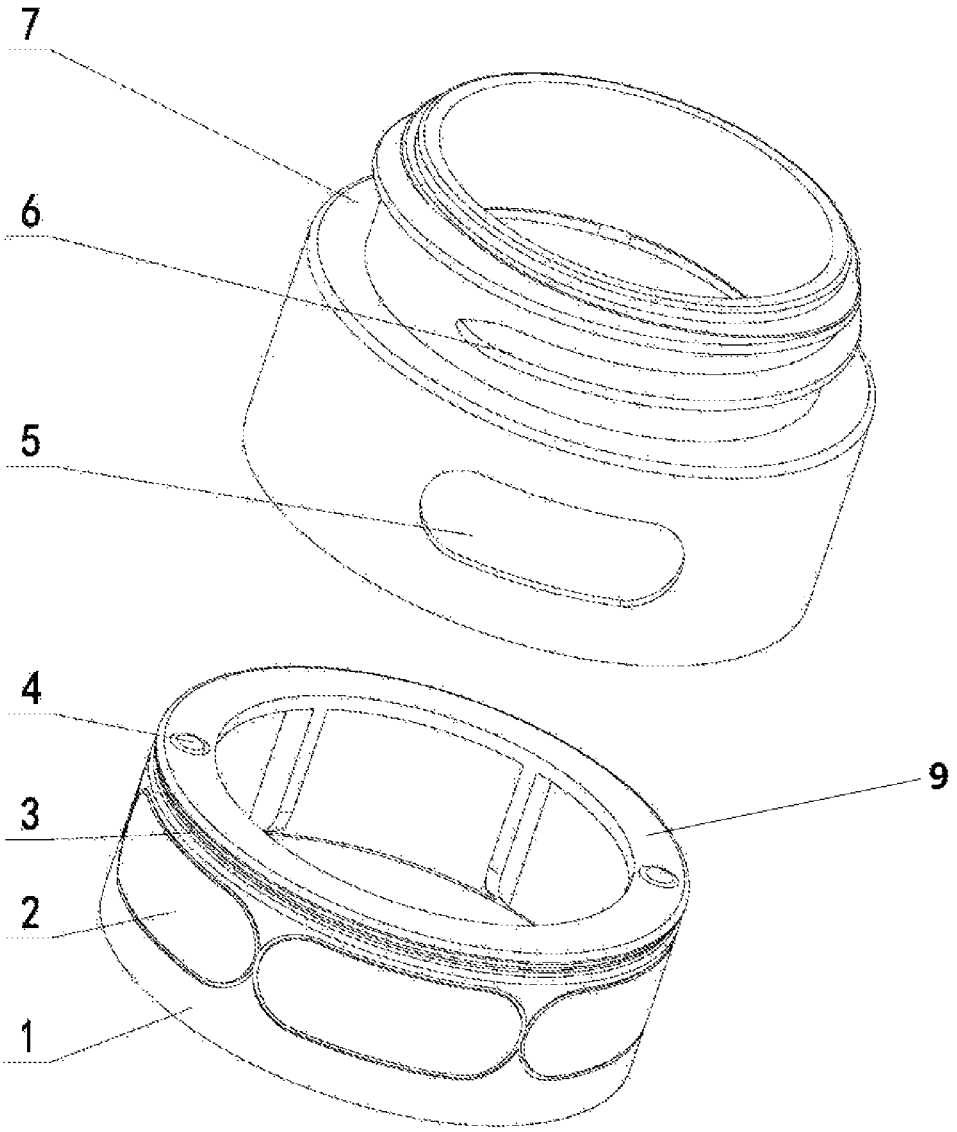
FIG. 2 is an exploded view of an embodiment of the bottle neck structure.
Figure 3:
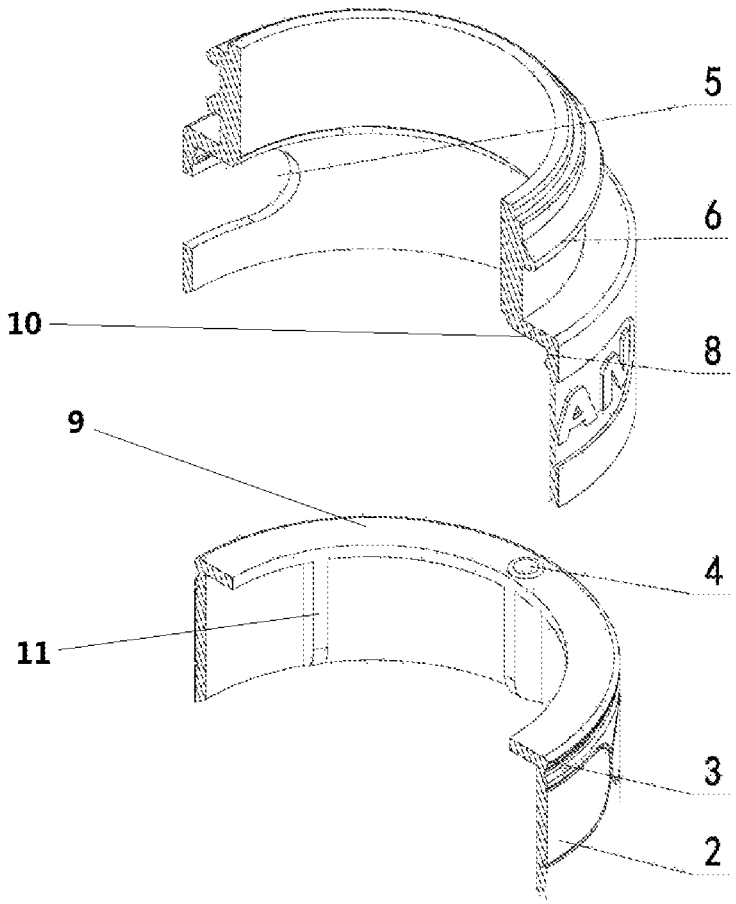
FIG. 3 is a sectional view of an embodiment of the bottle neck structure.

Further features and advantages of the present device, as well as the structure and operation of various embodiments of the present device, will become apparent and more readily appreciated from the following description of the preferred embodiments, taken in conjunction with the accompanying drawings of which:

FIGS. 1-3 show the structure of the bottle neck structure according to one embodiment. In this embodiment, the bottle neck structure can comprise an inner ring and an outer ring 7; wherein the inner ring can further comprise at least one display panel 2, a annular rim 3, a top facing surface 9 and at least one protrusion 4; wherein the outer ring can further comprise a annular groove 8, a thread structure 6, a bottom facing surface 10, at least one recess (not shown) and at least one through hole 5; wherein the annular rim 3 is located near the top of the inner ring 1, the at least one displace panel 2 is located on the outer surface of the inner ring 1 beneath the annular rim 3, the at least one protrusions 4 is located on the top facing surface 9; wherein annular groove 8 is located in the inner surface of the outer ring 7 right beneath the bottom facing surface 10, the bottom facing surface 10 is formed in the inner surface of the outer ring 7, the at least one recess (not shown) is located in the bottom facing surface 10, the at least one through hole 5 is located on the outer ring, and a thread structure 6 is disposed on the outer surface of the outer ring 7.

In this embodiment, the annular rim 3 corresponds with the annular groove 8. The top facing surface 9 corresponds with the bottom facing surface 10. The at least one protrusion 4 corresponds with the at least one recess (not shown) on the bottom facing surface 10. The at least one display panel 2 and the at least one through hole 5 are substantially the same shape and size and correspond with each other.

In practice, inner ring 1 and the outer ring 7 connect with each other. The structure will then be coupled with the upper part of the bottle body. The annular rim 3 and the annular groove 8 are coupled together by disposing the annular rim 4 inside the annular groove 8. The protrusion 4 and the recess can be coupled together wherein the protrusion is disposed inside the recess thus eliminating the relative movement between the inner ring 1 and the outer ring 7. The display panel 2 corresponds to the through hole 5 in such a way that when they are aligned with each other, display panel 2 is exposed to via the through hole for view.

In another embodiment, the bottle neck structure can comprise an inner ring 1 and an outer ring 7; wherein the inner ring can further comprise a plurality of display panels 2, an annular rim 3, a top facing surface 9 and a plurality of protrusions 4; wherein the outer ring can further comprise an annular groove 8, a thread structure 6, a bottom facing surface 10, a plurality of recesses and one through hole 5; wherein the annular rim 3 is located at the top of the inner ring 1 and on the outer surface of the inner ring 1, the plurality of displace panels 2 are located on the outer surface of the inner ring 1 beneath the annular rim 3, the plurality of protrusions 4 are located on the top facing surface 9; wherein annular groove 8 is located in the inner surface of the outer ring 7 right beneath the bottom facing surface 10, the bottom facing surface 10 is formed in the inner surface of the outer ring 7, the plurality of recesses (not shown) are located in the bottom facing surface 10, the plurality of through holes 5 are located on the outer ring, and a thread structure 6 is located on the outer surface of the outer ring 7.

In this embodiment, when the inner ring 1 and the outer ring 7 are assembled together, the annular rim 3 corresponds with the annular groove 8. The top facing surface 9 corresponds with the bottom facing surface 10. There are same number of protrusions 4 as the recesses, wherein the protrusions 4 are disposed on top of the inner ring 1 in a circular arrangement, wherein the recesses are disposed in the bottom facing surface 10 in a circular arrangement. The position of each protrusion 4 corresponds to the position of a recess. The through hole 5 and each display panel are substantially the same shape and size. Each display panel 2 corresponds to the through hole 5 in such a way that when they are aligned with each other, display panel 2 is exposed to via the through hole 5 for view.

In practice, inner ring 1 and the outer ring 7 connect with each other. The structure will then be coupled with the upper part of the bottle body. The annular ring 3 and the annular groove 8 are coupled together by disposing the annular rim 4 inside the annular groove 8. The protrusions 4 and the recesses are coupled together wherein each protrusion is disposed inside a corresponding recess thus eliminating the relative movement between the inner ring 1 and the outer ring 7. When the protrusions 4 and the recesses are coupled, one of the display panels 2 is aligned with the through hole 5 in a way that the display panel 2 is exposed for view through the through hole 5.

In this embodiment, the display panel 2 aligned with the through hole 5 can be changed by rotating the out ring 7 relative to the inner ring 1. When the outer ring 7 is rotated, the protrusions 4 are disengaged from the recesses so that the next display panel 2 can be rotationally aligned with the through hole 5. When the next display panel 2 is aligned with the through hole 5, the protrusions 4 and the recesses are engaged again.

Preferably, the protrusions 4 are symmetrically disposed on the top facing surface 9 of the inner ring 1 and the recesses are symmetrically disposed on the bottom facing surface of the outer ring 7.

Preferably, the protrusions 4 are circular shape and the recesses are also circular shape so the two can be engaged smoothly and disengaged smoothly.

Preferably, the inner surface of the inner ring 1 further comprise a plurality of ribs to increase friction, thereby facilitating the rotation of the inner ring;

Preferably, there is a groove around the display panel 2 to enable accurate labeling by users.

Preferably, the upper portion of the outer ring 7 is provided with a threaded cap 6 to connect the outer ring to the structure.

Embodiments of the invention described above is not intended to limit the scope of the present invention. Any modifications within the spirit and principles of the present invention made, equivalent replacement and improvement, should be included in the protection of the rights of the present invention of claim scope.

The invention claimed is:

1. A bottle neck structure comprising:

an inner ring and an outer ring, a thread structure for coupling with a bottle cap, a plurality of protrusions and a plurality of recesses;

wherein the inner ring further comprising a plurality of display panels, an annular rim, a top facing surface;

wherein the outer ring further comprising an annular groove, a bottom facing surface and one through hole; wherein the bottom facing surface is formed at the middle of the outer ring, wherein the thread structure is formed at the top of the outer ring above the bottom facing surface;

and wherein each of the display panels can be viewed through the through hole when they are aligned.

2. The bottle neck structure as described in claim 1, wherein the plurality of recesses are disposed in the bottom facing surface, and wherein the plurality of protrusions are disposed on the top facing surface.

3. The bottle neck structure as described in claim 2, wherein the plurality of recesses are symmetrically disposed on the top facing surface of the inner ring, and wherein the plurality of protrusions are symmetrically disposed in the bottom facing surface of the outer ring.

4. The bottle neck structure as described in claim 1, wherein the plurality of protrusions are disposed in the bottom facing surface, and wherein the plurality of recesses are disposed on the top facing surface.

5. The bottle neck structure as described in claim 4, wherein the plurality of protrusions are symmetrically disposed on the top facing surface of the inner ring, and wherein the plurality of recesses are symmetrically disposed in the bottom facing surface of the outer ring.

6. The bottle neck structure as described in claim 1, wherein the annular rim is located at the top of the inner ring, wherein the plurality of display panels are disposed on the outer surface of the inner ring, wherein annular groove is disposed on the inner surface of the outer ring, wherein the bottom facing surface is formed in the inner surface of the outer ring, wherein the through hole is located on the outer ring.

7. The bottle neck structure as described in claim 1, wherein the plurality of protrusions are circular shape and wherein the plurality of recesses are circular shape.

8. The bottle neck structure as described in claim 1, wherein the inner ring further comprising a plurality of ribs.

9. A bottle neck structure comprising:

an inner ring and an outer ring;

a thread structure for coupling with a bottle cap, wherein the inner ring further comprising a plurality of display panels, an annular rim, a top facing surface and a plurality of protrusions;

wherein the outer ring further comprising an annular groove; a bottom facing surface; a plurality of recesses and one through hole; and wherein the bottom facing surface is formed at the middle of the outer ring, wherein the thread structure is formed at the top of the outer ring above the bottom facing surface.

10. The bottle neck structure as described in claim 9, wherein the annular rim is located at the top of the inner ring, wherein the plurality of display panels are disposed on the outer surface of the inner ring, wherein the plurality of protrusions are disposed on the top facing surface, wherein the annular groove is disposed on the inner surface of the outer ring, wherein the bottom facing surface is formed in the inner surface of the outer ring, wherein the plurality of recesses are disposed in the bottom facing surface, wherein the through hole is located on the outer ring.

11. The bottle neck structure as described in claim 9, wherein the plurality of protrusions are symmetrically disposed on the top facing surface of the inner ring, and wherein the plurality of recesses are symmetrically disposed in the bottom facing surface of the outer ring.

12. The bottle neck structure as described in claim 9, wherein the plurality of protrusions are circular shape and wherein the plurality of recesses are circular shape.

13. The bottle neck structure as described in claim 9, wherein the inner ring further comprising a plurality of ribs.

14. The bottle neck structure as described in claim 9, wherein the outer ring further comprising a thread structure for coupling with a bottle cap.

15. A bottle neck structure comprising:

an inner ring and an outer ring;

wherein a bottom facing surface is formed at the middle of the outer ring, wherein a thread structure is formed at the top of the outer ring for coupling with a bottle cap above the bottom facing surface;

wherein the inner ring further comprising a plurality of display panels, an annular rim, and a plurality of protrusions;

wherein the outer ring further comprising an annular groove; a plurality of recesses and one through hole;

wherein each of the display panels can be viewed through the through hole when they are aligned.

16. The bottle neck structure as described in claim 15, wherein the annular rim is located at the top of the inner ring and on the outer surface of the inner ring, the plurality of display panels are located on the outer surface of the inner ring, and wherein annular groove is located in the inner surface of the outer ring.

17. The bottle neck structure as described in claim 15, wherein the at least one protrusion is circular shape and wherein the at least one recess is circular shape.

18. The bottle neck structure as described in claim 15, wherein the inner surface of the inner ring further comprising a plurality of ribs.

* * * * *